US008130255B2

(12) United States Patent
Bischel et al.

(10) Patent No.: US 8,130,255 B2
(45) Date of Patent: Mar. 6, 2012

(54) METHOD AND SYSTEM FOR SELECTING TOTAL JOB TIME PRINT

(75) Inventors: Patrick Oscar Bischel, Paris, KY (US); Michael Duane Donovan, Lexington, KY (US); Kevin Dean Schoedinger, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 786 days.

(21) Appl. No.: 12/147,663

(22) Filed: Jun. 27, 2008

(65) Prior Publication Data

US 2009/0324274 A1 Dec. 31, 2009

(51) Int. Cl.
*B41J 2/435* (2006.01)

(52) U.S. Cl. ..... 347/262; 347/264

(58) Field of Classification Search ..... 347/231, 347/237, 243, 247, 259–261, 16, 139, 234, 347/235, 248, 262, 264; 399/82–87
See application file for complete search history.

(56) References Cited

U.S. PATENT DOCUMENTS

| | | | | |
|---|---|---|---|---|
| 6,240,264 | B1 * | 5/2001 | Yajima et al. | 399/82 |
| 6,882,805 | B2 * | 4/2005 | Mizuno | 399/45 |
| 7,136,089 | B2 | 11/2006 | Able et al. | |
| 7,349,113 | B2 * | 3/2008 | Ferlitsch et al. | 358/1.15 |
| 2002/0039195 | A1 * | 4/2002 | Miyake | 358/1.15 |

* cited by examiner

*Primary Examiner* — Hai C Pham

(57) ABSTRACT

A system and a method for improving total job time without needing to know a job size. An engine dynamically decides which process speed to warm up to based on a number and size of pages currently submitted to the engine, and thus deliver the best job time dynamically. The engine also takes into account its condition and a condition of a fuser, and dynamically selects a substantially optimum point of operation.

16 Claims, 6 Drawing Sheets

METHOD AND SYSTEM FOR SELECTING TOTAL JOB TIME PRINT

STATEMENT REGARDING FEDERALLY SPONSORED RESEARCH OR DEVELOPMENT

None.

REFERENCE TO SEQUENCE LISTING, ETC.

None.

BACKGROUND

1. Field of the Invention

The present invention relates generally to selecting total job time for printing. In particular, the invention relates to selecting total job time for printing without knowing the job size.

2. Description of the Related Art

The prior art was focused upon knowing the job size (i.e. the number of pages) in order to select an engine speed for delivering a faster total job time. Job size in the prior art would be determined in one of two ways:

1. Job size would be determined implicitly by forcing the printer to warm up to a lower speed point. This would be accomplished by a menu setting and would provide for a better job time for short jobs, but would penalize all jobs that had large page counts.

2. The page count in the prior art would be specified by the job itself up front—where the engine would warm up accordingly. The problem with this approach is that the job size is not generally specified in the job and almost all the host applications do not have the infrastructure required to provide this data.

It would therefore be desirable to provide a method and system for improving total job time—the time to first print and the time to first copy—without needing to know the job size. In this way it would be possible to eliminate the need for modifying the job or the host application that is used to create and to send the job.

SUMMARY

The present invention provides for a method and a device for improving total job time without the need to know the engine speed based on this criteria. This criteria includes the number and size of the pages currently submitted to the engine in order to deliver the best job time dynamically; the engine taking into account the initial condition of the engine, of the fuser and dynamically selecting the most optimal operating point.

DETAILED DESCRIPTION

The present disclosure now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Figure 1:
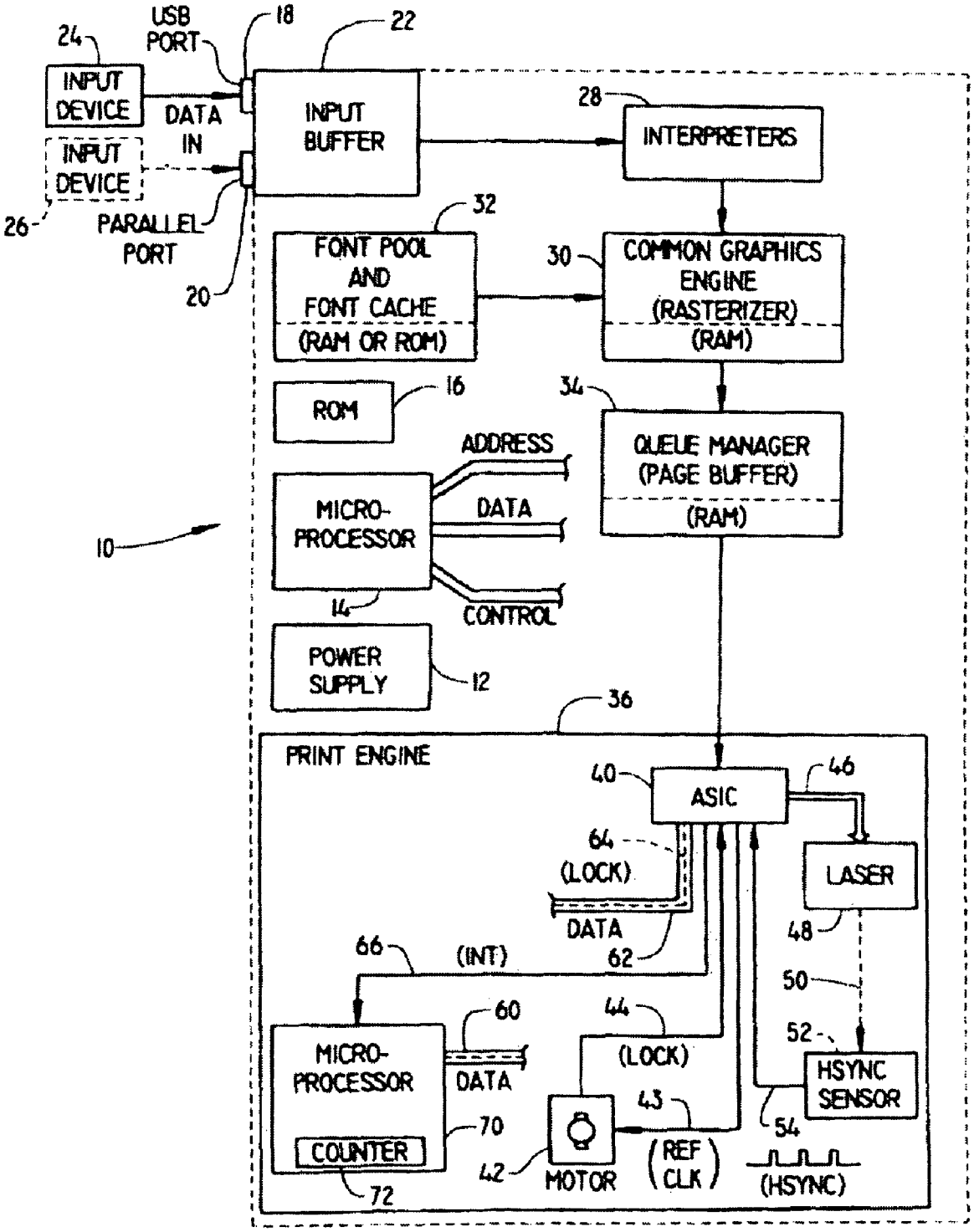
FIG. 1 is a hardware block diagram of the major components used in a laser printer which may incorporate this invention.
Figure 2:
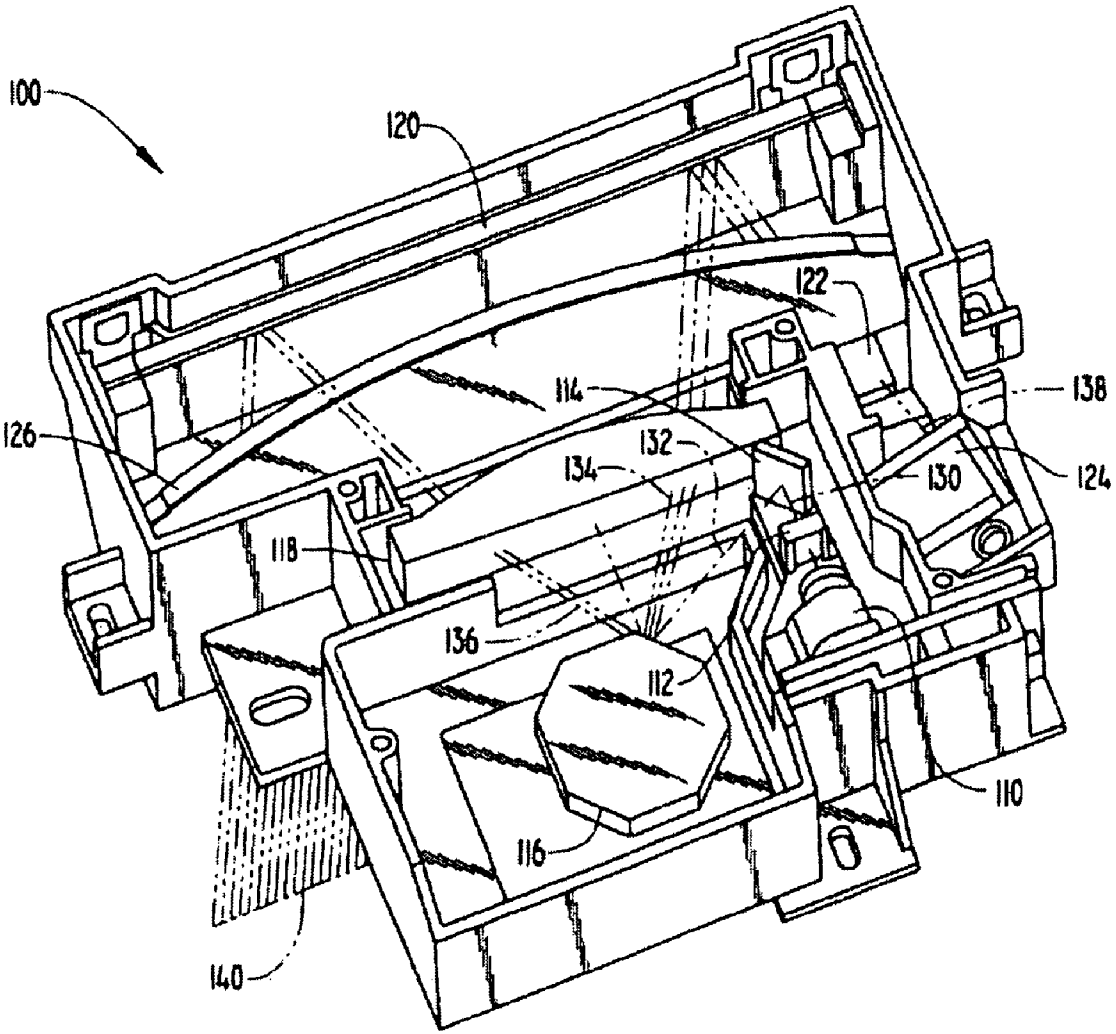
FIG. 2 is a perspective view in partial cut-away of a laser print head particularly showing the details of the light pathways from the laser to the HSYNC sensor.
Figure 3:
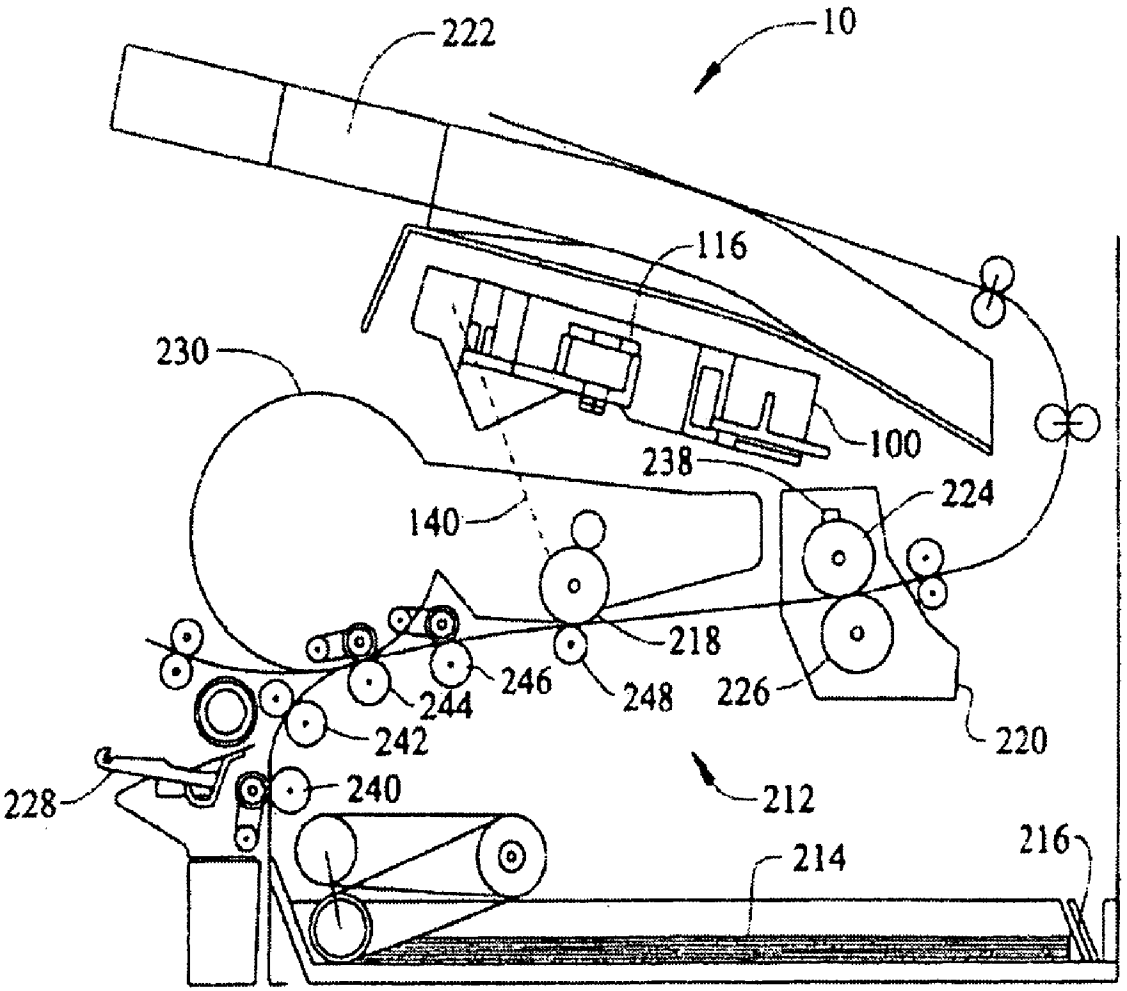
FIG. 3 is a cutaway, diagrammatic side view of major hardware elements of an illustrative laser printer which may incorporate this invention.

Printing System:

Referring now to the drawings, FIGS. 1-3 of the drawings are substantially identical to a corresponding figure in U.S. Pat. No. 7,136,089 that is assigned to the same assignee as the present invention, there is shown in FIG. 1 a hardware block diagram of a laser printer generally designated by the reference numeral 10. Laser printer 10 will preferably contain certain relatively standard components such a DC power supply 12 which may have multiple outputs of different voltage levels, a microprocessor 14 having address lines, data lines and control and/or interrupt lines. Read Only Memory (ROM) 16, and Random Access Memory (RAM), is divided into several portions for performing several different functions.

Laser printer 10 will typically contain at least one network input (not shown), parallel input or USB port, or in many cases two or more types of input ports, so designated by the reference numeral 18 for the USB port and the reference numeral 20 for the parallel port. Each of these ports 18 and 20 would be connected to a corresponding input buffer, generally designated by the reference number 22 on FIG. 1. USB port 18 would typically be connected to a USB output port of a personal computer or a workstation that would contain a software program such as a word processor or a graphics package or computer aided drawing package. Similarly, parallel port 20 could also be connected to a parallel output port of the same type of personal computer or workstation containing the same type of programs, only the data cable would have several parallel lines. Such input devices are designated, respectively, by the reference numerals 24 and 26 on FIG. 1.

Once the text or graphical data has been received by input buffer 22, it is commonly communicated to one or more interpreters designated by the reference numeral 28. A common interpreter is PostScript.™ which is an industry standard used by most laser printers. After being interpreted, the input data is typically sent to a common graphics engine to be rasterized, which typically occurs in a portion of RAM designated by the reference numeral 30 on FIG. 1. To speed up the process of rasterization, a font pool and possibly also a font memories are designated by the reference numeral 32 on FIG. 1. Such font pools and caches supply bitmap patterns for common alphanumeric characters so that the common graphics engine 30 can easily translate each such character into a bitmap using a minimal elapsed time Once the data has been rasterized, it is directed into a queue manager or page buffer, which is a portion of RAM, designated by the reference number 34. In a typical laser printer, an entire page of rasterized data is stored in the queue manager during the time interval that it takes to physically print the hard copy for that page. The data within the queue manager 34 is communicated in real time to a print engine designated by the reference numeral 36. Print engine 36 includes the laser light source within the print head, and its output results in physical inking onto a piece of paper, which is the final print output from laser printer 10.

It will be understood that the imaging device might receive data from a scanner (not shown) or by facsimile, and therefore not need some of the image processing elements discussed in the foregoing.

It will be understood that the address, data and control lines are typically grouped in buses, and which are physically communicated in parallel (sometimes also multiplexed) electrically conductive pathways around the various electronic components within laser printer 10. For example, the address and data buses are typically directed to all input or output integrated circuits that act as buffers.

Print engine 36 contains an ASIC (Application Specific Integrated Circuit) 40, which acts as a controller and data manipulating device for the various hardware components within the print engine. The bitmap print data arriving from Queue Manager 34 is received by ASIC 40, and at the proper moments is sent via signal lines 46 to the laser, which is designated by the reference numeral 48.

ASIC 40 controls the various motor drives within the print engine 36, and also receive status signals from the various hardware components of the print engine. A motor 42 is used to drive the faceted mirror (see the polygonal mirror 116 on FIG. 2) and when motor 42 ramps up to a rotational speed (i.e. its "lock" speed) that is dictated or measured by the frequency of a reference signal ("REF CLK") at a signal line 43, a "Lock" signal will be enabled on a signal line 44 that is transmitted to ASIC 40.

The lock signal may be dictated or controlled by various alternatives. Where the lock speed is to be different for different applications by the same printer 10, reference frequencies are supplied to track motor 42 supporting different lock speeds at different reference frequencies. Virtually any practical means to determine when a motor is at a stabilized, predetermined speed are alternatives and many such means as well within the state of the art or may be developed in the future. For purposes of this invention lock speed equates to the speed of rotation of mirror 116 (FIG. 2) employed for actual printing of a given page of a given print job.

During conventional operation, once ASIC 40 receives the lock signal from motor 42, it transmits a corresponding lock signal (as part of a byte of a digital signal) along one of the data lines 64 of the data bus 62 that communicates with ASIC 40. Data bus 62 is either the same as the data bus 60 that communicates with microprocessor 70, or a portion thereof. (In practice microprocessor 70 and microprocessor 14 may be a single processor.) When this lock status signal is received by microprocessor 70, microprocessor 70 initiates action of printer 10 leading to printing by printer 10 in normal course.

The HSYNC signal is received from an optical sensor designated by the reference number 52 and called the HSYNC sensor. The laser light source 110 (see FIG. 2) places a spot of light on the rotating polygonal mirror 116, which then redirects the laser light so that it ultimately sweeps or "scans" across a "writing line" on a photoconductive drum (218 in FIG. 3), thereby creating a raster line of either black or white print elements (also known as "pels"). As the laser light scans to create this raster line, the laser light momentarily sweeps across HSYNC sensor 52 at the beginning of each sweep or "scan" across one of the facets of polygonal mirror 116. The laser light travels from laser 110 to the HSYNC sensor 52 along a light path, designated diagrammatically by the reference numeral 50 on FIG. 1. This produces an electrical pulse output signal from HSYNC sensor 52, which is communicated to ASIC 40 by a signal line 54.

As related above, a counter, designated by the reference numeral 72, is allowed to operate within microprocessor 70 (alternatively, counter 70 is within ASIC 40) and its value is saved every time a signal is received over the control line 66. By use of the different values of the count taken at each interrupt, microprocessor 70 (alternatively, ASIC 40) can determine the frequency of HSYNC signal.

FIG. 2 provides a perspective partially cut-away view of some of the major components of a print head 100 of laser printer 10. Starting at the laser light source 110, the light travels through a lens 112 along a pathway 130 and is redirected by a "pre-scan" mirror 114. The redirected light path, designated by a reference numeral 132, puts a spot of light on an eight-sided polygonal mirror 116. Some of the other major optical components within laser printer 10 include a lens 118, a "post-scan" fold mirror 120, a "start of scan" mirror 122, an optical sensor mounted to an HSYNC sensor card 124, and another lens 126 that directs the light into a "writing line" designated by reference 140.

After the laser light leaves the laser source 110, it is focused by lens 112 into a narrow beam that follows light path 130, before arriving at the pre-scan mirror 114. This mirror redirects the light into a path 132 which strikes a spot on the polygonal mirror 116. As mirror 116 rotates (due to motor 42), the reflected laser light is swept by one of the facets of mirror 116 from a starting position for each raster scan at the reference number 134, to an ending position of the raster scan at the reference numeral 136. The ultimate goal is to sweep the laser light across a photoconductive drum (not shown), thereby creating a series of parallel light paths as "writing lines" and designated by reference numeral 140. To achieve this writing line 140, the swept laser light is directed through lens 118 and reflected in a downward direction the fold mirror 120. The final lens 126 is used to provide the final aiming of the swept light that creates writing line 140.

A portion of the swept light that creates each raster scan is aimed by the polygonal mirror 116, lens 118, fold mirror 120, and a "start of scan" mirror 122 to create a light signal that follows the path designated by the reference numeral 138. Light that ultimately travels along path 138 will be directed to impact an optical sensor on the HSYNC sensor card 124, and the optical sensor is equivalent to the HSYNC sensor 52 seen on FIG. 1. In FIG. 2 since there are eight (8) facets or sides to polygonal mirror 116, each one-eighth rotation of mirror 116 will create an entire swept raster scan of laser light that ultimately becomes the writing line 140. For a small instant at the start of each of these scans, there will be a light beam that travels along path 138 to impact the HSYNC sensor 52 on the HSYNC sensor card 124. This HSYNC signal will be created during each scan at all times during normal operation of laser printer 10 when laser source 110 and motor 42 are running during a printing operation, even during scans in which there are no pels to be printed on the photoconductive drum in that scan. Laser source 110 is controlled such that it will produce no light at all for raster lines that are to be left blank on the final printed page, except for a brief moment at the end of each scan, so that the HSYNC signal will be produced at the beginning of each successive scan FIG. 3 illustrates major structural aspects of a representative printer 10. Printer 10 includes a media feed path 212 for feeding sheets of media 214, such as paper, from media tray 216 past a photoconductive drum 218 and a fuser assembly 220 to an output tray 222. The fuser assembly 20 may be a nip roller fuser formed by a fuser roller 224, which is heated to a relatively high temperature to fuse particles of toner to the sheets of media 214, and a backup roller 225.

Special media, such as envelopes, transparencies or checks, are fed into the media feed path 212 from an external, front-option tray 228, sometimes referred to as a multi-purpose tray. Photoconductive drum 218 forms an integral part of a replaceable toner cartridge 230 inserted in the printer 10.

Print head 100 is disposed in the printer 10 for scanning the photoconductive drum 218 with a laser beam 140 to form a latent image thereon. The laser beam 140 sweeps or "scans" across a "writing line" on the photoconductive drum 218, thereby creating, in a black and white laser printer, a raster line of either black or white print elements.

A plurality of rollers 240, 242, 244, 246, 248 function in a known manner to transfer the sheets of media 214 from the media tray 216 or multi-purpose tray 228 through the media feed path 212. As is entirely standard, the paper or other media 214 receives the toner image from drum 218 and advances into the nip of fuser roller 224 and backup roller 226, where the toner image is fixed to the media 214 by being fused with heat. A thermistor 238 or other heat sensor senses the temperature of the fuser 220, typically by being in contact with the fuser roller 224. This temperature information is communicated to microprocessor 70 (FIG. 1) and microprocessor 70 controls power to a heating element (not shown) in or near the fuser roller to control the temperature. Such control of fuser temperature is widely practiced in various forms, and any such control is consistent with this invention.

When mirror motor 42 is inactive, the time to reach printing speed can be much longer than the time to feed media 214 to the photoconductor drum 218. Accordingly, it is standard to delay printing until mirror motor 42 reaches a predetermined speed consistent to being ready to complete printing when media 214 contacts drum 218. Similarly, when fuser 220 is cool or only moderately warm, the time to reach fixing temperature can be much longer than the time required to convey media from media tray 216 to the fuser 220. Accordingly, it is common both to maintain fuser 220 at high intermediate temperature (which is often termed a standby mode) and to delay printing as necessary.

To practice this invention, normally the mirror 116 will be supported for rotation on a bearing (not shown) that is subject to virtually no wear during rotation, such as an air bearing. As the rotation of any mirror motor requires power and produces some sound, which may be distracting, the mirror is not kept at full speed during an inactive period.

To preserve power at the fuser, the temperature at the heater is reduced soon after the print job is completed at the fuser. This intermediate, lower temperature is selected to ensure that the fuser can be heated to reach the fixing temperature by the time a sheet of media reaches the fuser.

Accordingly, a standby condition is created in which the rotation speed of the mirror motor is reduced substantially. In the illustrative printer 10 that speed may be reduced from 52,000 revolutions per minute to 25,000, and the power to the laser is removed to deactivate the laser. The fuser temperature is reduced a moderate amount. In the illustrative printer 10 the reduction in this standby condition may be from 206 degrees C. to 180 degrees C.

The 52,000 revolutions per minute speed is the speed for high-speed printing. The 25,000 speed is a standby speed between the 52,000 speed and very low or off, but is less than the speed for intermediate speed printing. Accordingly, some time is required for the 25,000 speed to be increased to the speed for intermediate speed printing.

A print job initiated during this standby condition is delayed significantly. This standby condition may be continued for some as both power consumption and sound production is significantly low. A typical period to maintain this standby condition is about 60 minutes. Longer periods for this standby condition are sometimes preferred and are employed. The period may be only a few minutes for certain users, but is normally much higher.

After a certain period of time without a print job, the mirror motor is stopped (or, if practical, reduced to very slow rotation) and the fuser temperature is further reduced or the fuser is no longer heated at all. In a system consistent with the foregoing, the temperature may be reduced to 175 degrees C.

The turning off (or very slow rotation) of the mirror motor with a low fuser temperature constitutes another standby condition, which is standard in itself.

The foregoing is implemented by microprocessor 70 or equivalent electronic control logic such as by an ASIC. Such control, in itself, may employ existing printing systems, as discussed with respect to the illustrative embodiment 10 of FIGS. 1-3.

In the practice of this invention, the imaging device, for which the printer of FIGS. 1-3 is illustrative, prints at a first, intermediate speed, and a second, higher speed. (The printer being capable of other speeds is consistent with this invention.)

When a print job is received, microprocessor 70 or other device electronic control is normally explicitly informed from the data in the print job of the number of pages in the print job. Similarly, such information might be entered by an operator of the imaging device directly or through a network connection to the imaging device. Alternatively, the electronic control might derive the number of pages from the content of the print job.

When a printer has to print a job from power saver or standby, there is a delay required to get the engine calibrated and warmed-up enough to pick paper. The amount of this set-up time is directly proportional to the print speed. Normally a faster printer will print large wide media jobs in less time, but smaller jobs can be printed in less total time if the engine instead prints at a slower process speed that has a much shorter set-up time.

The present disclosure provides a method and a device in which the engine dynamically decides which process speed to warm up to based on the number and size of pages currently submitted to the engine, and thus delivers the best job time dynamically.

The engine can also take into account the initial condition of the engine, especially the fuser, and dynamically select the most optimum op point. For example, if the printer just finished a large job at 55 ppm, and the fuser is still warm when a small job comes in, total job time would be less if the 55 ppm op point was chosen in this case.

The method and device of the present disclosure does not require a page count to be included in the job data which, in almost all circumstances, is not available.

Figure 4:
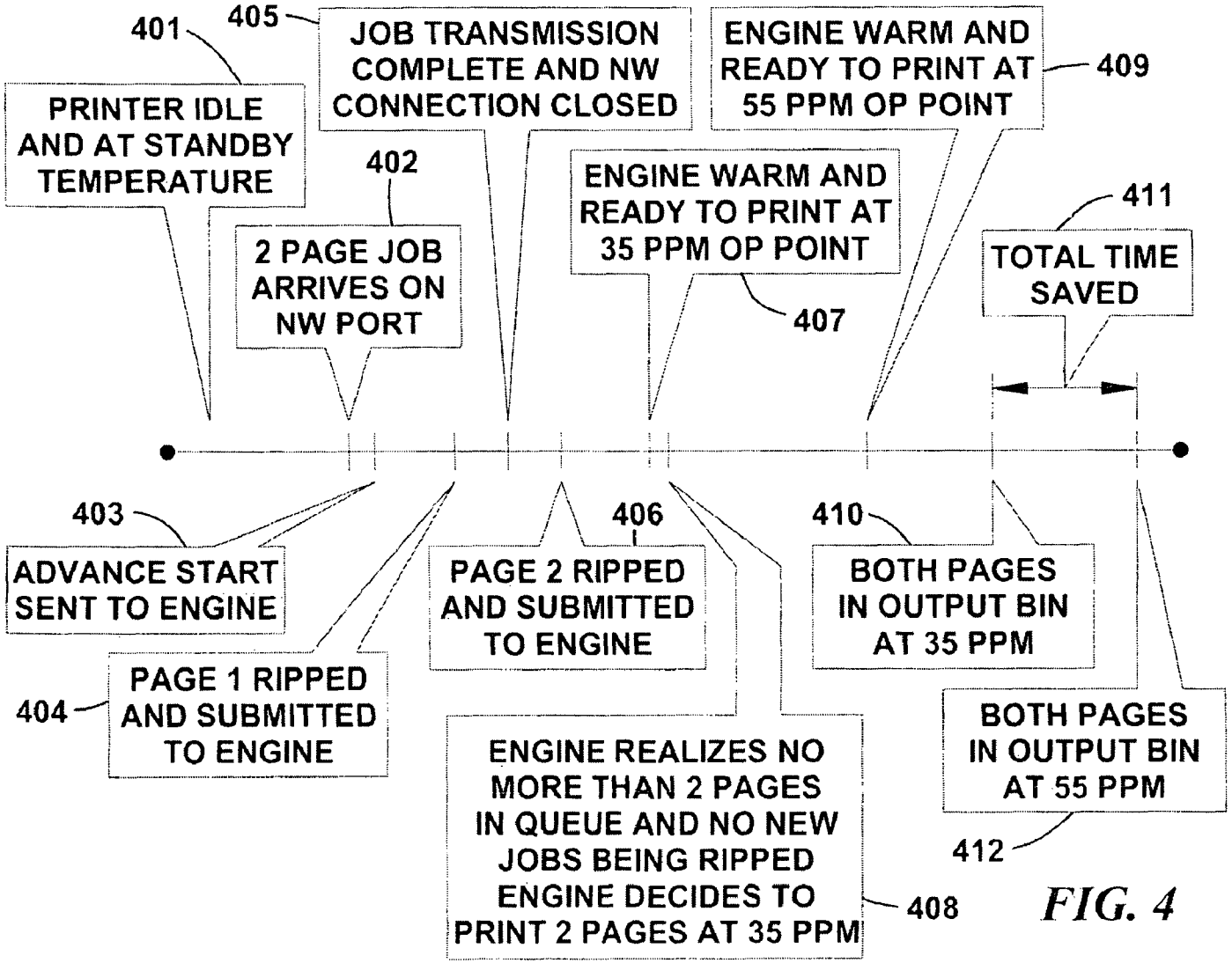
FIG. 4 is a timeline illustrating how a slower process can be leveraged to deliver better overall performance in accordance with the method and system of the present invention.

FIG. 4 is a timeline graph illustrating the leveraging of a slower process in order to deliver better overall performance in accordance with the method and system of the present invention. Criteria are used to determine the best engine speed selection e.g. 35 ppm or 55 ppm for the engine to run to operate the job. This is determined by communication between the Routing Information Protocol (RIP) firmware and the engine firmware with each other. The firmware is stored in NAND flash memory on the controller.

The RIP firmware runs as a group of Linux applications. The Engine firmware runs as a Linux Device Driver. The RIP communicates to the Engine through direct calls to the Engine device driver and passes a memory buffer with command information. The Engine communicates back to the RIP using a "notify" interface. The Engine code writes to a small memory buffer any time it needs to "notify" the RIP. The RIP is constantly monitoring the notify buffer for non-zero values. When it finds a non-zero value it calls the Engine driver directly with a request for the specific "notify" information.

Referring to FIG. 4, at time 401 of the timeline in FIG. 4 the printer is idle and at standby temperature. At time 402 the two page job has arrived in the network (NW) port. The advance start is sent to the engine at time 403. Page 1 of the two page job is ripped and submitted to the engine at time 404. The job transmission is completed and the network connection is closed at time 405. Page two of the two page job is ripped and sent to the engine at time 406. At time 407 the engine is warmed and ready to print the job at a speed of 35 ppm op (optimal) point. At time 408 the engine recognizes that no more than 2 pages are in the queue for printing and no new job is being ripped. The engine decides to print the job at 2 pages at the speed of 35 PPM. Time 409 shows the time when the engine could alternatively be warmed and ready to print the two page job at 55 ppm at op point. Time 410 shows when the two pages of the job are in the output bin when the engine is set for 35 ppm for the job. Time 412 shows the time when the two pages of the job are in the output bin when the engine speed is set at 55 ppm for the job. Time 411 shows the difference in time and time saved by using the method and the device of the present disclosure by choosing the engine speed 35 ppm rather than 55 ppm given the criteria, e.g. the engine was initially idle and at standby temperature; less than six pages were being printed for the job and no new jobs were being ripped.

Figure 5:
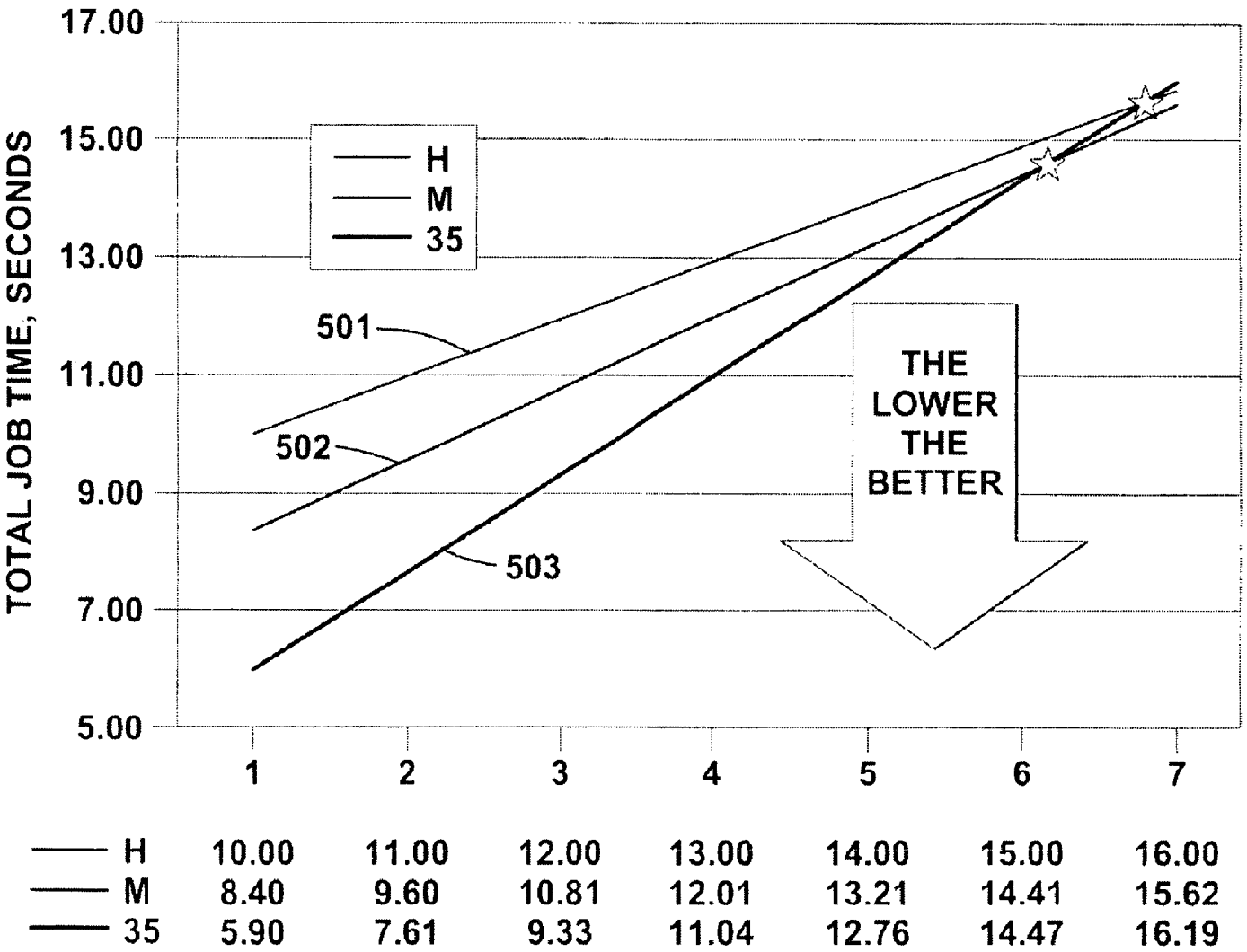
FIG. 5 is a graph illustrating an embodiment of the present invention for wide media e.g. wide paper showing improvement of total job time based on the number of wide media pages in the job.

FIG. 5 illustrates how total job time can be improved in accordance with the method and system of the present disclosure for a job for printing papers on a wide media. Line 501 represents a high engine speed. Line 502 represents a medium engine speed. Line 503 represents a low engine speed, by way of illustrative non-limiting example 35 ppm. The graph of FIG. 5 represents total job time verses job size in pages for a wide media job. As can be seen from the three lines 501, 502, 503 of the graph in FIG. 5 that for job sizes in the queue of less than six pages a lower engine speed is preferable for a wide media job and results in a lower total job time. If the job size is six pages or greater, then a higher engine speed, preferably that of line 501 will be selected for the engine in the present invention for a wide media. Thus one of the criteria that the engine will use to determine its selection of engine speed is if the media is a wide media and if less than six pages are in the queue-if so a low engine speed will be selected of 35 ppm by communication with the RIP firmware. If larger than six or more pages are in the queue for a wide media the engine speed will be high to improve the total job time.

Figure 6:
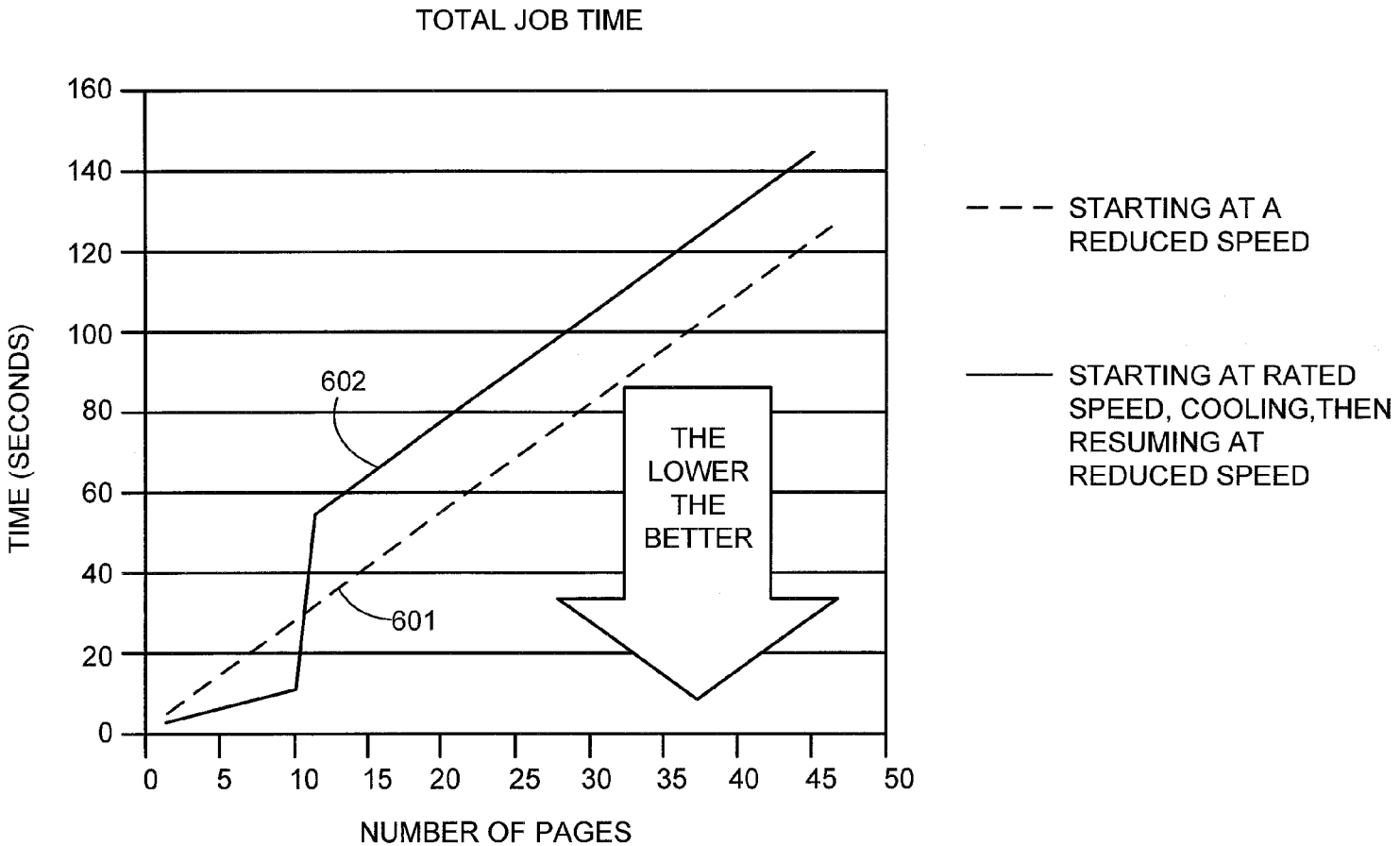
FIG. 6 is a graph illustrating an embodiment for the present invention for non-wide media showing improvement of total job time based on the number of non-wide media pages in the job.

FIG. 6 illustrates how total job time can be improved in accordance with the method and system of the present disclosure for a job for printing papers on a non-wide media. The present invention provides for an improvement in total job time by determining if there are more than ten pages of non-wide media in the queue and if so, selecting a reduced speed (line 601). If ten or less pages of non-wide media are in the queue, then the engine speed is selected at the rated speed (line 602) providing better total job time. The reason is that when the job is started at a higher speed, a cooling delay is incurred.

The foregoing description of several embodiments of the invention has been presented for purposes of illustration. It is not intended to be exhaustive or to limit the invention to the precise forms described, and obviously many modifications and variations are possible in light of the above teaching. It is intended that the scope of the invention be defined by the claims appended hereto.

What is claimed is:

1. An imaging device, comprising:

a controller of the imaging device dynamically determining a speed at which the imaging device is to operate based upon a number of pages and size of the pages currently in a queue for printing by the imaging device;

wherein the controller selectively operates the imaging device to operate at a first speed when: (a) at least one print job in the queue is for printing on a first media size and a number of pages less than a first predetermined number of pages; and (b) the at least one print job is for printing on a second media size that is less than the first media size and a number of pages greater than a second predetermined number of pages greater than the first predetermined number of pages, and operates the imaging device to operate at a second speed greater than the first speed when the at least one print job is for printing using at least one other combination of media size and a number of pages to be printed.

2. The imaging device of claim 1, wherein the speed is selected based on communications between firmware of the controller and RIP (Routing Information Protocol) firmware, the RIP firmware communicates to the controller firmware through direct calls to a device driver of the controller and passes a memory buffer with command information, and the controller communicates back to the RIP firmware using an interface for notification.

3. The imaging device according to claim 1 wherein the speed is selected based on communications between firmware of the controller and RIP (Routing Information Protocol) firmware, the controller writes to a memory buffer when the controller needs to provide notification to the RIP firmware and the RIP firmware monitors the memory buffer for at least one predetermined value so that when the RIP firmware finds at least one predetermined value in the memory buffer, a device driver of the controller is directly called with a request for specific notification information.

4. The imaging device according to claim 1, wherein the controller includes firmware that communicates with RIP (Routing Information Protocol) firmware regarding page count and page size in the queue for determining a selection of the speed.

5. The imaging device according to claim 1 wherein the page size is selectable between at least wide media and non-wide media.

6. The imaging device according to claim 1 wherein if in the queue the number of pages of the first media size to be printed is greater than or equal to the first predetermined number then the controller operates the imaging device to print the at least one print job at the second speed.

7. The imaging device according to claim 1, wherein if in the queue the size of the pages to be printed is the second media size, and if the number of pages to be printed is less than or equal to the second predetermined number, then the controller operates the imaging device to begin printing at the second speed and complete printing of the at least one print job at the first speed.

8. The imaging device according to claim 1 wherein the controller selectively operates the imaging device to operate at the second speed when: (a) the at least one print job is for printing on the first media size and a number of pages is greater than the first predetermined number of pages; and (b) the at least one print job is for printing on the second media size and a number of pages less than or equal to the second predetermined number of pages.

9. A method for printing by an imaging device, comprising:

dynamically determining a speed at which the imaging device is to operate based upon a number of pages and size of the pages currently in a queue for printing by the imaging device; and operating the imaging device at the determined speed, wherein the operating comprises selectively operating the imaging device to operate at a first speed when: (a) at least one print job in the queue is for printing on a first media size and a number of pages is greater than a first predetermined number of pages; and (b) the at least one print job is for printing on a second media size smaller than the first media size and a number of pages is less than or equal to a second predetermined number of pages greater than the first predetermined number of pages, and selectively operating the imaging device to operate at a second speed slower than the first speed when the at least one print job is for printing using at least one other combination of media size and a number of pages to be printed.

10. The method of claim 9, wherein the determining comprises determining the speed based on an initial condition of a print engine and a fuser of the imaging device.

11. The method of claim 9, wherein the size of the pages is selectable between wide media and non-wide media.

12. The method of claim 9, wherein the operating comprises selectively operating the imaging device to operate at the second speed when: (a) the at least one print job in the queue is for printing on the first media size and a number of pages is less than the first predetermined number of pages; and (b) the at least one print job is for printing on the second media size and a number of pages greater than the second predetermined number of pages.

13. The method of claim 9, wherein the operating comprises selectively operating the imaging device to operate at a slower speed that is slower than the first speed when the at least one print job in the queue is for printing on the first media size and a number of pages is less than the first predetermined number of pages.

14. The method of claim 9, wherein the operating comprises selectively operating the imaging device to operate at a slower speed that is slower than the first speed when the at least one print job is for printing on the second media size and a number of pages is greater than the second predetermined number of pages.

15. An imaging device, comprising:

a controller of the imaging device dynamically determining a speed at which the imaging device is to operate based upon a number of pages and size of the pages currently in a queue for printing by the imaging device, wherein the controller selects the speed based on whether the imaging device has just finished printing a relatively large print job at a higher speed so that if the print job in the queue is a relatively small print job the speed of the imaging device is maintained at the relatively high speed and if the print job in the queue is a relatively large print job, then the controller selects a lower speed.

16. The imaging device of claim 15, wherein the speed is selected based on communications between firmware of the controller and RIP (Routing Information Protocol) firmware, the controller writes to a memory buffer when the controller needs to provide notification to the RIP firmware and the RIP firmware monitors the memory buffer for at least one predetermined value so that when the RIP firmware finds at least one predetermined value in the memory buffer, a device driver of the controller is directly called with a request for specific notification information.

* * * * *